US007174959B2

(12) United States Patent
Pratt

(10) Patent No.: US 7,174,959 B2
(45) Date of Patent: Feb. 13, 2007

(54) DOWNHOLE SEPARATOR SYSTEM AND METHOD

(75) Inventor: Christopher A. Pratt, Cochrane (CA)

(73) Assignee: CDX Gas, LLC, Dallas, TX (US)

( * ) Notice: Subject to any disclaimer, the term of this patent is extended or adjusted under 35 U.S.C. 154(b) by 322 days.

(21) Appl. No.: 10/824,087

(22) Filed: Apr. 14, 2004

(65) Prior Publication Data

US 2005/0241826 A1 Nov. 3, 2005

(51) Int. Cl.
*E21B 43/38* (2006.01)

(52) U.S. Cl. ..... 166/265; 166/105.5; 166/372

(58) Field of Classification Search ..... None
See application file for complete search history.

(56) References Cited

U.S. PATENT DOCUMENTS

| | | | |
|---|---|---|---|
| 2,319,702 | A | 5/1943 | Moon |
| 4,231,767 | A | 11/1980 | Acker |
| 4,241,787 | A | 12/1980 | Price |
| 4,366,861 | A | 1/1983 | Milam |
| 4,481,020 | A | 11/1984 | Lee et al. |
| 4,688,650 | A | 8/1987 | Hayatdavoudi et al. |
| 5,389,128 | A | 2/1995 | Lopes |
| 5,431,228 | A | 7/1995 | Weingarten et al. |
| 5,482,117 | A | 1/1996 | Kolpak et al. |
| 5,653,286 | A | 8/1997 | McCoy et al. |
| 5,902,378 | A | 5/1999 | Obrejanu |
| 5,996,690 | A | 12/1999 | Shaw et al. |
| 6,039,121 | A | 3/2000 | Kisman |

(Continued)

OTHER PUBLICATIONS

Notification of Transmittal of the International Search Report and the Written Opinion of the International Searching Authority, or the Declaration (3 pages), International Search Report (3 pages), and Written Opinion of the International Searching Authority (5 pages) for international application No. PCT/US2005/012432 mailed Jul. 11, 2005.

(Continued)

*Primary Examiner*—Zakiya W. Bates
(74) *Attorney, Agent, or Firm*—Fish & Richardson P.C.

(57) ABSTRACT

According to one embodiment of the invention, a downhole separation method includes forming a main wellbore extending from a surface to a subterranean zone, disposing a production liner into the main wellbore proximate the subterranean zone, coupling a first end of a first tube to the production liner, coupling an entrance portion of a second tube to an outside surface of and adjacent a second end of the first tube such that an entrance of the second tube is at a lower elevation than the second end of the first tube, and causing a flow of a mixture through the production liner and the first tube. The mixture includes a gas, a liquid, and a plurality of coal fines. The method further includes retrieving the gas via the main wellbore after the mixture exits the second end of the first tube and retrieving at least the liquid through the second tube.

43 Claims, 3 Drawing Sheets

U.S. PATENT DOCUMENTS

| | | | |
|---|---|---|---|
| 6,080,312 | A | 6/2000 | Bowers et al. |
| 6,176,311 | B1 | 1/2001 | Ryan |
| 6,367,547 | B1 | 4/2002 | Towers et al. |
| 6,394,182 | B1 | 5/2002 | Fadel |
| 6,494,258 | B1 | 12/2002 | Weingarten |
| 6,550,535 | B1 | 4/2003 | Traylor |
| 6,627,081 | B1 | 9/2003 | Hilditch et al. |
| 6,719,048 | B1 | 4/2004 | Ramos et al. |
| 6,736,880 | B2 * | 5/2004 | Ford et al. ..... 95/248 |

OTHER PUBLICATIONS

Notification of Transmittal of the International Preliminary Report on Patentability (1 page) and International Preliminary Report on Patentability (9 pages) for international application No. PCT/US2005/012432 mailed Mar. 29, 2006.

* cited by examiner

DOWNHOLE SEPARATOR SYSTEM AND METHOD

TECHNICAL FIELD OF THE INVENTION

The present invention relates generally to recovery of subterranean resources and, more particularly, to a downhole separator system and method.

BACKGROUND OF THE INVENTION

Subterranean deposits of coal, also referred to as coal beds, contain substantial quantities of entrained resources, such as natural gas (including methane gas or any other naturally occurring gases). Production and use of natural gas from coal deposits has occurred for many years. However, substantial obstacles have frustrated more extensive development and use of natural gas deposits in coal beds.

One such obstacle is the separation of the gas from the liquid and solids during production. Above ground separation systems are sometimes utilized. In addition, gas anchors have sometimes been used for this function in coal bed methane production.

SUMMARY OF THE INVENTION

According to one embodiment of the invention, a downhole separation method includes forming a main wellbore extending from a surface to a subterranean zone, disposing a production liner into the main wellbore proximate the subterranean zone, coupling a first end of a first tube to the production liner, coupling an entrance portion of a second tube to an outside surface of and adjacent a second end of the first tube such that an entrance of the second tube is at a lower elevation than the second end of the first tube, and causing a flow of a mixture through the production liner and the first tube. The mixture includes a gas, a liquid, and a plurality of coal fines. The method further includes retrieving the gas via the main wellbore after the mixture exits the second end of the first tube and retrieving at least the liquid through the second tube.

Some embodiments of the invention provide numerous technical advantages. Some embodiments may benefit from some, none, or all of these advantages. For example, according to certain embodiments, resource production from a wellbore is improved by an efficient separation of water and obstructive material from the retrieved gas while avoiding the problems of plugging up the separation equipment. Furthermore, in certain embodiments, obstructive material, such as coal fines, may be collected downhole for later removal.

Other technical advantages are readily apparent to one skilled in the art.

BRIEF DESCRIPTION OF THE DRAWINGS

Reference is now made to the following description taken in conjunction with the accompanying drawings, wherein like reference numbers represent like parts, in which.

DETAILED DESCRIPTION

Figure 1B:
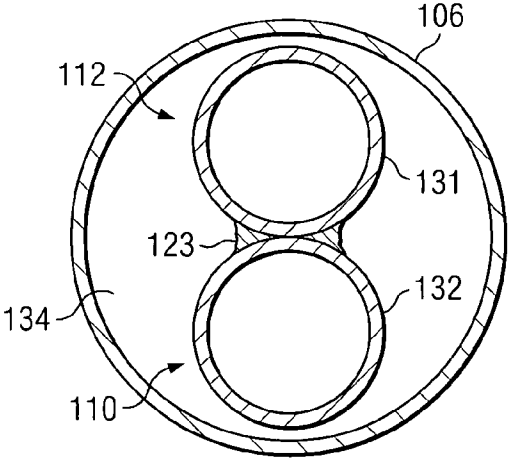
FIG. 1B is a cross-section of the downhole separator system of FIG. 1A.
Figure 1A:
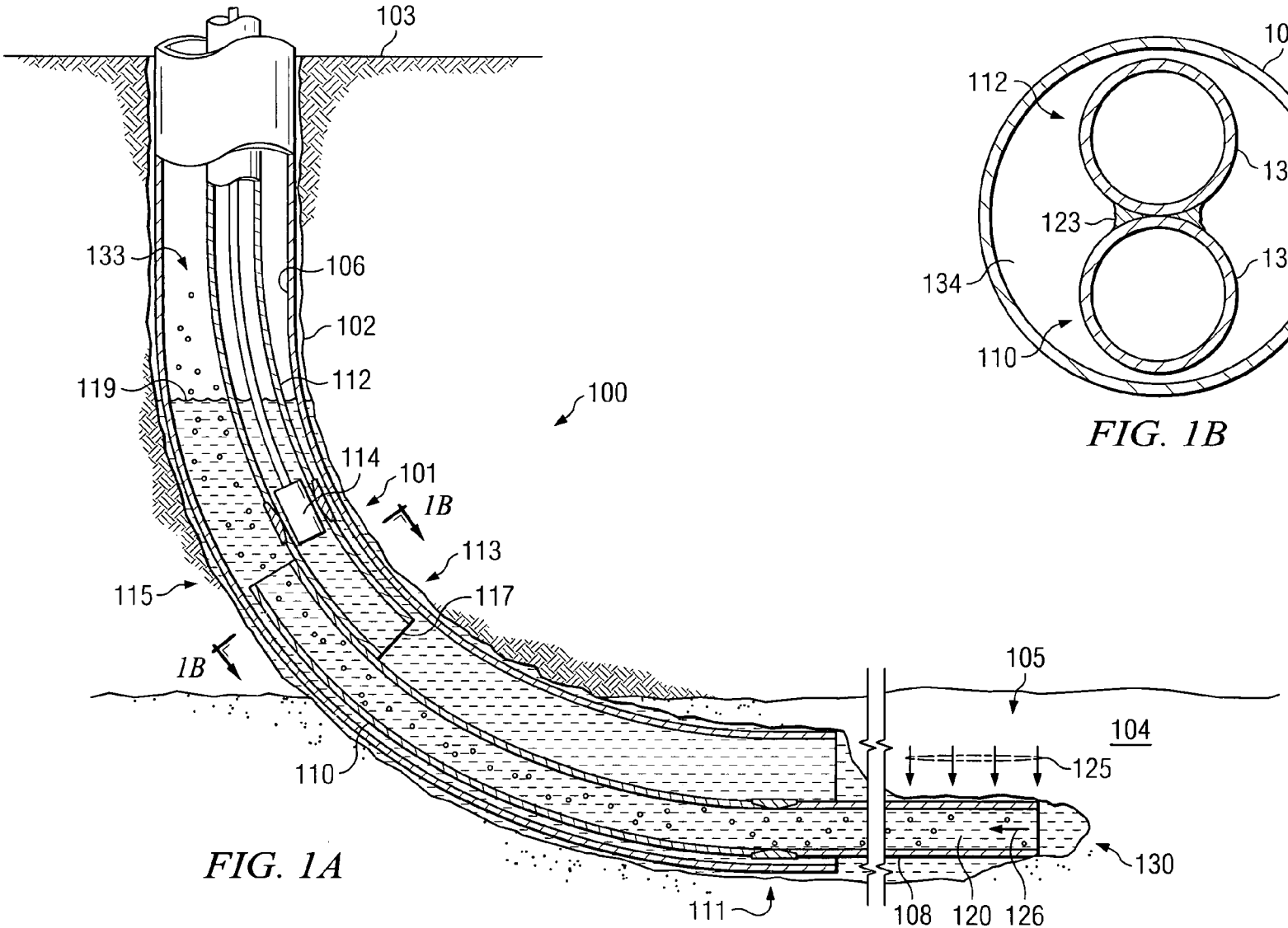
FIG. 1A is a cross-sectional elevation view of a well including a downhole separator system in accordance with one embodiment of the present invention.

FIG. 1A is a cross-sectional elevation view of a well 100 including a downhole separator system 101 in accordance with one embodiment of the present invention. Downhole separator system 101 extracts and separates resources from a subterranean zone 104 via a main wellbore 102 that extends from a ground surface 103 to subterranean zone 104. Although subterranean zone 104 may be any suitable subterranean zone containing or entraining any suitable resources, the following detailed description assumes that subterranean zone 104 is a coal bed that entrains a natural gas, such as methane.

Main wellbore 102 may be drilled using any suitable technique. For example, main wellbore 102 may be drilled with a drill string that includes a suitable downhole motor and drill bit. A measurement while drilling ("MWD") device may be included in the BHA for controlling the orientation and direction of the drill bit. A drainage portion 105 of main wellbore 102 may be positioned wholly or partly in subterranean zone 104. As illustrated in FIG. 1A, drainage portion 105 is substantially horizontal; however, drainage portion 105 is not required to be horizontal. For example, where main wellbore 102 is a down-dip or an up-dip wellbore, drainage portion 105 may be sloped. In addition, drainage portion 105 may be approximately horizontal with respect to subterranean zone 104, regardless of whether subterranean zone 104 is parallel to ground surface 103. In one embodiment, drainage portion 105 may be angled or vertical with respect to subterranean zone 104.

Conventionally, a wellbore is drilled to reach a coal bed that includes resources, such as natural gas. Once a wellbore is formed, a mixture of resources, water, and coal fines may be forced out of the coal bed through the wellbore because of the pressure difference between the surface and the coal bed. The mixture may be collected at the surface and separated at the surface or the mixture may be separated within the wellbore by separation systems, the most common being a gas anchor.

According to the teachings of some embodiments of the present invention, system 101 is utilized to separate and extract resources from subterranean zone 104 in a manner that reduces and/or minimizes clogging of extraction tools due to excessive particle accumulation. Efficiency of gas production may be improved in subterranean zone 104 in some embodiments. Generally, system 101 is operable to separate the gas, the liquid, and the particles and allow them to be dealt with separately. Although the term "separation" is used, complete separation may not occur. For example, separated water may still include a small amount of particles. Details of example embodiments of system 101 are provided below in conjunction with FIGS. 1A through 3B.

Referring to FIGS. 1A and 1B, system 101 includes a production liner 108 disposed within main wellbore 102 proximate drainage portion 105. Production liner 108 can be any suitable liner formed from any suitable material that has apertures formed therein. Apertures may include holes, slots, or other suitable openings. In particular embodiments, the use of holes may allow production of more coal fines than the use of slots, while the use of slots may provide more alignment of the apertures with cleats in the coal than when using holes. Apertures may be included in any appropriate portion along the length of production liner 108. The sizes of apertures may be adjusted depending on the size of coal fines or the particles that are desired to be kept outside production liner 108. Screens may also be utilized to keep coal fines or particles outside production liner 108.

In one embodiment, as denoted by arrows 125, drainage portion 105 is allowed to collapse around at least a portion of production liner 108 after production liner 108 has been disposed therein. This allows higher permeability of drainage portion 105, which as described above, may result in a more efficient resource production because the higher porosity allows freer movement of gas into production liner 108.

As denoted by arrow 126, a mixture 120 is shown to be flowing within production liner 108. Mixture 120, as described above, includes at least the formation fluids and solids, such as gas desired to be extracted, a liquid such as water, and coal fines or other particles. It is this mixture 120 that is desired to be separated by system 101. This is described in greater detail below.

A first tube 110 is coupled to production liner 108 via any suitable coupling method at a first end 111. In other embodiments, production liner 108 is integral with first tube 110. First tube 110 may be any suitable conduit having any suitable diameter that is operable to transport mixture 120 up through main wellbore 102. The pressure existing in drainage portion 105 helps facilitate the upward travel of mixture 120 through first tube 110. For example, if casing 106 is a seven inch outside diameter production casing, then first tube 110 may be a two and seven-eighths inch outside diameter tube. First tube 110 may have any suitable length and second end 115 may terminate at any suitable position within main wellbore 102, such as the vertical or curved portion of main wellbore 102. In a particular embodiment, second end 115 terminates somewhere below an expected liquid level 119 within main wellbore 102.

In one embodiment, an entrance portion 113 of a second tube 112 is coupled to an outside surface of and adjacent a second end 115 of first tube 110 such that an entrance 117 of second tube 112 is at a lower elevation than second end 115 of first tube 110. Although any suitable overlap may exist between second tube 112 and first tube 110, in a particular embodiment, approximately six to seven meters of overlap exists between second tube 112 and first tube 110 to provide enough strength at the joint. As shown best in FIG. 1B, an outside surface 131 of second tube 112 couples to an outside surface 132 of first tube 110 so that second tube 112 and first tube 110 are side-by-side. Second tube 112 may be coupled to first tube 110 in any suitable manner; however, in one embodiment, second tube 112 is coupled to first tube 110 by welding, as indicated by reference numeral 123.

Second tube 112 is utilized as a pumping tube to pump liquid out from main wellbore 102 via a suitable pump 114. In the illustrated embodiment, pump 114 comprises a rod pump; however, any suitable pump may be utilized to pump liquid from main wellbore 102, such as a progressive cavity pump and a downhole centrifugal pump. System 101 may also include a suitable casing 106 for casing at least a portion of main wellbore 102. In a particular embodiment, casing 106 is a seven inch O.D. production casing.

A technical advantage of having second tube 112 outside of and overlapping first tube 110 is improved separation of gas from mixture 120 while preventing particles such as coal fines from plugging up the separation assembly. An example operation of system 101 is described below, which more clearly illustrates the technical advantage just described.

In operation of one embodiment of the invention, after main wellbore 102 is drilled and cased with casing 106, first tube 110 is coupled to production liner 108 and second tube 112 is coupled to first tube 110. Pump 114 is disposed within second tube 112 and then the assembly is run-in-hole until production liner 108 is proximate drainage portion 105 of main wellbore 102. Drainage portion 105 is allowed to collapse around production liner 108 to increase the permeability of that portion of subterranean zone 104.

Mixture 120 including gas, liquid, and coal fines enters production liner 108, as indicated by arrow 126, and, because of the downhole pressure, is transported through first tube 110 up toward surface 103. The mixture 120 exits second end 115 of first tube 110 and establishes liquid level 119, which may vary or be held substantially steady. At this point, the gas continues to rise up main wellbore 102, as indicated by reference numeral 133, while the liquid and coal fines fall back down through main wellbore 102. Because the coal fines are heavier than the liquid, the coal fines settle along the bottom of annulus 134 of main wellbore 102 while the liquid is pumped to the surface 103 via pump 114 through second tube 112 after it enters entrance 117. Entrance 117 of second tube 112 is disposed below liquid level 119 in order to facilitate the pumping of the liquid. The liquid may contain a small amount of coal fines. Thus, efficient separation of gas from the liquid and coal fines in mixture 120 is facilitated by system 100.

Figure 2B:
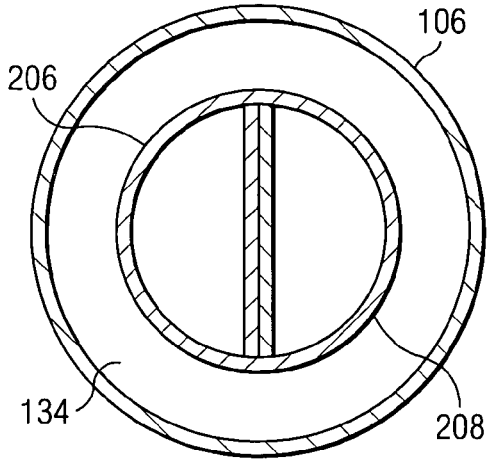
FIG. 2B is a cross-section of the downhole separator system of FIG. 2A.
Figure 2A:
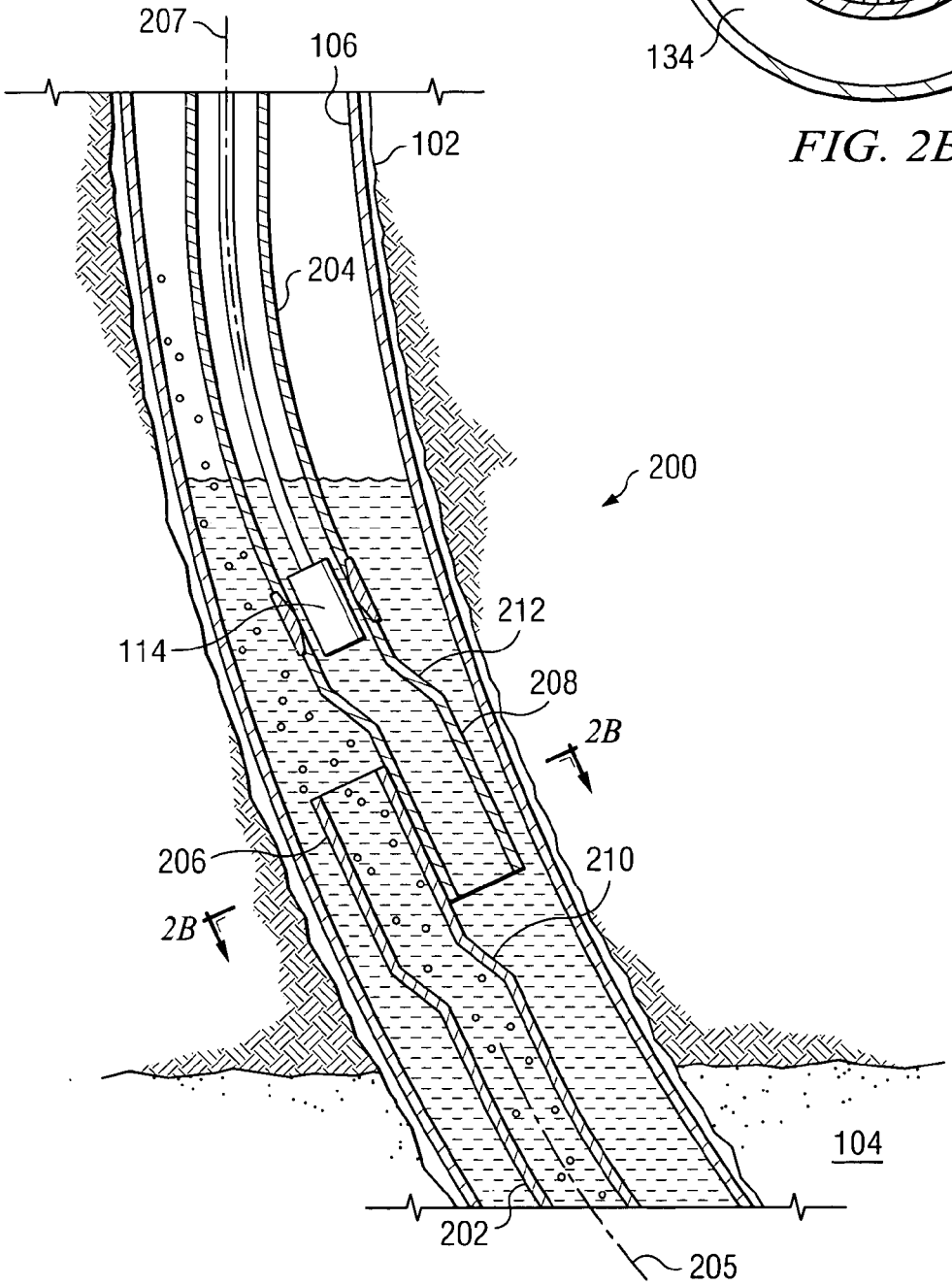
FIG. 2A is a cross-sectional elevation view of a downhole separator system in accordance with another embodiment of the present invention.

FIG. 2A is a cross-sectional elevation view of a downhole separator system 200 in accordance with another embodiment of the present invention. The embodiment illustrated in FIGS. 2A and 2B is similar to the embodiment in FIGS. 1A and 1B except in the area where the tubes couple to one another.

Referring to FIG. 2A, a first tube 202 includes an exit portion 206 that couples to an entrance portion 208 of a second tube 204. A transition portion 210 of first tube 202 and a transition portion 212 of second tube 204 allow a centerline 205 of first tube 202 and a centerline 207 of second tube 204 to substantially align with one another. This allows both first tube 202 and second tube 204 to be larger in diameter than first tube 110 and second tube 112 of the embodiment illustrated in FIGS. 1A and 1B. This may also facilitate easier maneuverability within main wellbore 102.

Although exit portion 206 and entrance portion 208 may have any suitable shape, in one embodiment as illustrated in FIG. 2B, both exit portion 206 and entrance portion 208 take the shape of a half circle that are coupled to one another along their straight sides. Any suitable coupling method may be utilized, such as welding. In another embodiment, exit portion 206 and entrance portion 208 are formed as one piece having a common wall. In this embodiment, the combined piece couples to transition portions 210 of first tube 202 and transition 212 of second tube 204. An operation of one embodiment of system 200 illustrated in FIGS. 2A and 2B is similar to the operation of system 101 illustrated in FIGS. 1A and 1B, as described above.

Figure 3A:
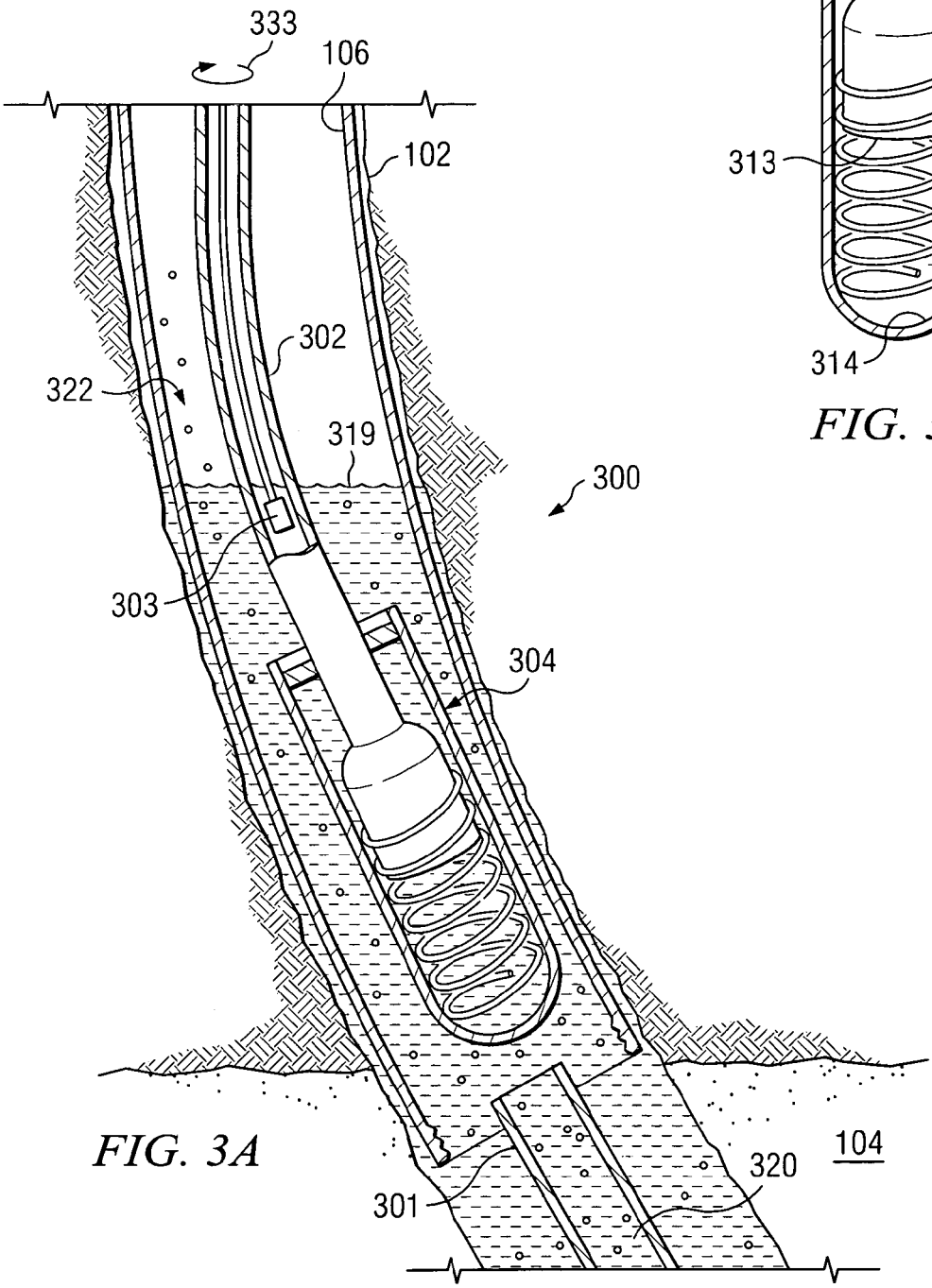
FIG. 3A is a cross-sectional elevation view of a three phase downhole separator system in accordance with an another embodiment of the present invention.

FIG. 3A is a cross-sectional elevation view of a downhole separator system 300 in accordance with another embodiment of the present invention. An additional advantage of system 300 is that system 300 includes a separator assembly 304 that functions to not only separate the gas from the liquid and coal fines but also more efficiently separate and collect the coal fines from the liquid for later removal.

System 300 includes a production liner 301 disposed below casing 106 within main wellbore 102. Production liner 301 functions in a similar manner to production liner 108 as described above, except that in some embodiments production liner 301 may have a larger diameter. System 300 also includes a pumping tube 302 having a suitable pump 303 that couples to separator assembly 304 in any suitable manner. Pumping tube 302 may be any suitable conduit having pump 303 disposed therein that is operable to pump liquid from within main wellbore 102 to ground surface 103.

Figure 3B:
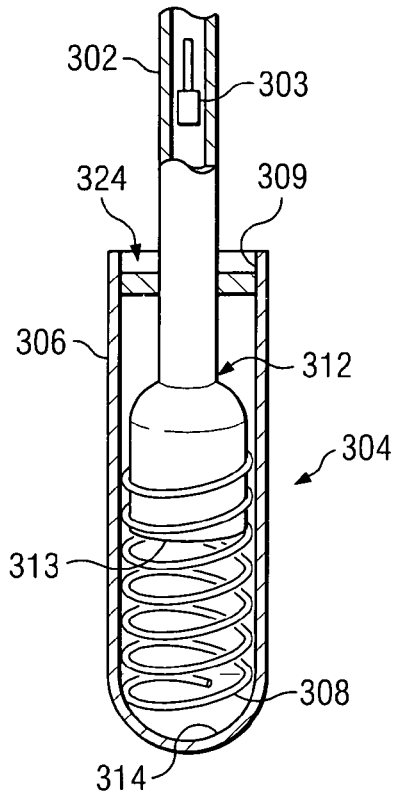
FIG. 3B is a cross-section of the three phase downhole separator system of FIG. 3A.

Referring to FIG. 3B, separator assembly 304 includes a basket 306 and a spiral vane 308 coupled to an inside 309 of basket 306. For example, spiral vane 308 may be welded to inside 309 of basket 306 or friction fit within basket 306. A portion of spiral vane 308 may also couple to an end portion 312 of pumping tube 302. In the illustrated embodiment, end portion 312 increases in diameter as it extends down basket 306. However, pumping tube 302, as well as end portion 312, may have any suitable shape and any suitable diameter.

Basket 306 may have any suitable size and shape; however, in one embodiment, basket 306 is generally circular, resembling a test tube. Basket 306 has a solid wall and includes a closed bottom 314 that functions to collect coal fines, as described further below. Spiral vanes 308 may have any suitable width and thickness and may be coupled to inside 309 of basket 306 in any suitable manner, such as welding. Any suitable portion of spiral vane 308 may couple to an outside surface of end portion 312. Spiral vane 308 may extend below an entrance 313 of pumping tube 312 via any suitable distance. Spiral vane 308 may also be helically shaped or have other suitable shapes that facilitate centrifugal motion as liquid and coal fines travel downward thereon. This is described in greater detail below.

In operation of one embodiment of system 300 illustrated in FIGS. 3A and 3B, after main wellbore 102 is drilled, production liner 301 is disposed within main wellbore 102. Separator assembly 304 is then coupled to pumping tube 102 and run-in-hole until a desired depth is reached. The depth is typically such that separator assembly 304 is disposed below an expected liquid level 319. As in the previous embodiments, a drainage portion (not shown) of subterranean zone 104 is allowed to collapse around production liner 301.

A mixture 320 flows during production upward through production liner 301 and casing 106 until reaching a liquid level 319 where the gas continues upward through casing 106, as denoted by reference numeral 322, while the liquid and coal fines fall back downward through main wellbore 102. The majority of liquid and coal fines are collected by basket 306. As indicated by arrows 324, the liquid and coal fines enter basket 306 and start moving down and around the outside of end portion 312 via spiral vane 308. Because of the spiral nature of spiral vane 308, the liquid and coal fine mixture accelerate as they move downward due to centrifugal motion, thereby pushing the heavier coal fines out towards the inside of basket 309. In this manner, when the mixture reaches entrance 313 of pumping tube 302, pump 303 is able to pump mostly liquid up through pumping tube 302 to ground surface 103. Coal fines collect near the inside surface 309 of basket 306 and some may collect at the closed bottom 314.

Intermittently, pumping tube 302 may be rotated, as indicated by reference numeral 333, from ground surface 103 via any suitable method. This rotation of pumping tube 302 rotates the separator assembly 304 in order to move the coal fines accumulation downward to closed end 314 of basket 306. This essentially clears spiral vane 308 of coal fines. When enough accumulation of coal fines is experienced, separator assembly 304 may be removed from within main wellbore 102 so that basket 306 may be cleared of coal fines by any suitable dumping method. Separator assembly 304 may then be disposed back into main wellbore 102 for another separation operation.

In one embodiment, the internal cross-sectional area of the annulus between basket 306 and the extension of pumping tube 302 should be such that a downward velocity of the liquid and coal fines is less than a rising velocity of the gas. In some embodiments, this results in better separation of the gas 322 from the water and coal fines mixture.

Although some embodiments of the present invention are described in detail, various changes and modifications may be suggested to one skilled in the art. The present invention intends to encompass such changes and modifications as falling within the scope of the appended claims.

What is claimed is:

1. A downhole separation method, comprising:

disposing a first tube into a wellbore proximate a subterranean zone, at least part of the first tube comprising a production liner;

disposing a second tube in a well including the wellbore such that the second tube is outside of and overlaps a portion of the first tube and an entrance of the second tube is at a lower elevation than an exit end of the first tube;

causing a flow of a mixture through the production liner and the first tube, the mixture comprising a gas, a liquid, and a plurality of coal fines;

retrieving the gas via the well after the mixture exits the exit of the first tube; and retrieving at least the liquid through the second tube.

2. The method of claim 1, further comprising collapsing at least a portion of the wellbore around the production liner.

3. The method of claim 1, further comprising casing at least a portion of the well.

4. The method of claim 1, wherein the entrance of the second tube is approximately six to seven feet below the second end of the first tube.

5. The method of claim 1, wherein disposing a second tube comprises coupling an entrance portion of the second tube to the portion of the first tube.

6. The method of claim 1, wherein the first and second tubes comprise outside diameters of no more than 2⅞ inches.

7. The method of claim 1, further comprising substantially aligning a centerline of an upper portion of the first tube and a centerline of a lower portion of the second tube.

8. The method of claim 1, further comprising removing the liquid within the second tube via a pump disposed therein.

9. The method of claim 1, wherein the subterranean zone is a coal bed.

10. A downhole separation system, comprising:

a first tube disposed in a wellbore proximate a subterranean zone, at least part of the first tube comprising a production liner with apertures therein;

a second tube disposed in a well including the wellbore, the second tube outside of and overlapping a portion of the first tube such that an entrance of the second tube is at a lower elevation than an exit of the first tube;

a pump disposed within the second tube, the pump operable to remove the liquid within the second tube;

the first tube operable to receive a mixture comprising a gas, a liquid, and a plurality of coal fines from the subterranean zone and to release the gas up the well for production to a surface after the mixture exits the exit of the first tube; and the entrance of the second tube operable to receive at least the liquid from the mixture after the mixture exits the exit of the first tube and travels downward in elevation.

11. The system of claim 10, wherein at least a portion of the wellbore is collapsed around the production liner.

12. The system of claim 10, further comprising a casing disposed within at least a portion of the well.

13. The system of claim 10, wherein the entrance of the second tube is approximately six to seven feet below the second end of the first tube.

14. The system of claim 10, wherein an entrance portion of the second tube is coupled to an outside surface of the portion of the first tube.

15. The system of claim 10, wherein the first and second tubes comprise outside diameters of no more than 2⅞ inches.

16. The system of claim 10, wherein a centerline of an upper portion of the first tube and a centerline of a lower portion of the second tube are substantially aligned.

17. The system of claim 10, wherein an entrance portion of the second tube and the portion of the first tube define a transition region where they couple to one another, the transition region defining an area that facilitates a downward velocity of the liquid exiting the exit of the first tube being less than a rising velocity of the gas exiting the exit of the first tube.

18. The system of claim 10, wherein the subterranean zone is a coal bed.

19. A downhole separation method, comprising:

disposing a first tube in a wellbore proximate a subterranean zone, at least part of the first tube comprising a production liner;

disposing a pumping tube into a well including the wellbore;

coupling a separator assembly to an end of the pumping tube, the separator assembly comprising a basket and a spiral vane coupled to an inside of the basket;

causing a flow of a mixture through the production liner and upward through the well, the mixture comprising a gas, a liquid, and a plurality of coal fines;

retrieving the gas via the well;

directing the liquid and coal fines inside the basket and around the spiral vane; and retrieving at least the liquid from inside the basket.

20. The method of claim 19, further comprising rotating the separator assembly to direct the coal fines towards a bottom of the basket.

21. The method of claim 20, further comprising removing the separator assembly from the well to empty the coal fines from the basket.

22. The method of claim 19, further comprising collapsing at least a portion of the wellbore around the production liner.

23. The method of claim 19, further comprising casing at least a portion of the well.

24. The method of claim 19, further comprising causing a downward velocity of the liquid to be less than a rising velocity of the gas.

25. The method of claim 19, wherein the subterranean zone is a coal bed.

26. A downhole separator assembly, comprising:

a first tube disposed in a wellbore proximate a subterranean zone, at least part of the first tube comprising a production liner;

a pumping tube disposed in a well including the wellbore;

a separator assembly coupled to an end of the pumping tube, the separator assembly comprising a basket and a spiral vane coupled to an inside of the basket;

a mixture comprising a gas, a liquid, and a plurality of coal fines associated with the subterranean zone;

whereby the separator assembly defines an area that facilitates a downward velocity of the liquid less than a rising velocity of the gas such that the liquid and coal fines are directed inside the basket and around the spiral vane and the gas is allowed to move upward through the well for production to a surface; and whereby the pumping tube is operable to retrieve at least the liquid from inside the basket.

27. The system of claim 26, wherein the separator assembly is adapted to be rotated to direct the coal fines towards a bottom of the basket.

28. The system of claim 26, wherein an entrance of the pumping tube is disposed at an intermediate portion of the basket and the spiral vane extends below the entrance.

29. The system of claim 26, wherein the spiral vane is coupled between the inside surface of the basket and an outside surface of the pumping tube.

30. The system of claim 26, wherein a diameter of the pumping tube expands within the basket.

31. The system of claim 26, wherein at least a portion of the wellbore is collapsed around the production liner.

32. The system of claim 26, further comprising a casing disposed within at least a portion of the well.

33. The system of claim 26, wherein the subterranean zone is a coal bed.

34. A downhole separation method, comprising:

collecting a mixture from a coal bed in a production liner, the mixture comprising a gas, a liquid, and a plurality of coal fines;

causing the mixture to flow through the production liner and a first tube;

releasing the mixture into a wellbore, whereby the gas travels upward through the wellbore for production to a surface and the liquid and coal fines travel downward through the wellbore; and removing at least the liquid via a second tube outside of and overlapping a portion of the first tube.

35. The method of claim 34, further comprising collapsing at least a portion of the wellbore around the production liner.

36. The method of claim 34, wherein an entrance of the second tube is approximately six to seven feet below an exit of the first tube.

37. The method of claim 34, wherein the first and second tubes comprise outside diameters of no more than 2⅞ inches.

38. The method of claim 34, further comprising substantially aligning a centerline of an upper portion of the first tube and a centerline of a lower portion of the second tube.

39. A downhole separation method, comprising:

collecting a mixture from a coal bed in a production liner, the mixture comprising a gas, a liquid, and a plurality of coal fines;

causing a flow of the mixture through the production liner and upward through a wellbore;

directing the liquid and coal fines down into a basket while allowing the gas to travel upward through the wellbore for production to a surface;

directing the liquid and coal fines around a spiral vane coupled to an inside of the basket to centrifugally direct the coal fines towards a perimeter of the basket; and retrieving at least the liquid from a center of the basket.

40. The method of claim 39, further comprising rotating the basket to direct the coal fines towards a bottom of the basket.

41. The method of claim 40, further comprising removing the basket from the wellbore to empty the coal fines from the basket.

42. The method of claim 39, further comprising collapsing at least a portion of the wellbore around the production liner.

43. The method of claim 39, further comprising causing a downward velocity of the liquid and coal fines to be less than a rising velocity of the gas.

* * * * *